US007503773B2

(12) United States Patent
Tokunaga

(10) Patent No.: US 7,503,773 B2
(45) Date of Patent: Mar. 17, 2009

(54) CONNECTOR, MATING CONNECTOR AND BOARD-TO-BOARD CONNECTOR ASSEMBLY

(75) Inventor: Takashi Tokunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 41 days.

(21) Appl. No.: 11/600,577

(22) Filed: Nov. 16, 2006

(65) Prior Publication Data

US 2007/0111600 A1 May 17, 2007

(30) Foreign Application Priority Data

Nov. 16, 2005 (JP) ..... 2005-332231

(51) Int. Cl.
*H01R 12/00* (2006.01)

(52) U.S. Cl. ..... 439/74; 439/108

(58) Field of Classification Search ..... 439/66, 439/74, 91, 101, 108, 591, 660
See application file for complete search history.

(56) References Cited

U.S. PATENT DOCUMENTS 3,419,844 A * 12/1968 Schmued ..... 439/364
3,835,442 A * 9/1974 Anderson et al. ..... 439/86
4,574,331 A * 3/1986 Smolley ..... 361/735
4,710,133 A 12/1987 Lindeman
4,806,110 A 2/1989 Lindeman
4,824,383 A 4/1989 Lemke
4,988,306 A 1/1991 Hopfer, III et al.
4,992,053 A 2/1991 Lindeman et al.
5,004,427 A 4/1991 Lindeman
5,013,249 A 5/1991 Lindeman et al.
5,057,028 A 10/1991 Lemke et al.
5,127,837 A * 7/1992 Shah et al. ..... 439/71
5,169,324 A 12/1992 Lemke et al.
5,195,899 A * 3/1993 Yatsu et al. ..... 439/101
5,597,313 A 1/1997 Lindeman
RE35,508 E 5/1997 Lemke et al.
5,632,626 A * 5/1997 Collins et al. ..... 439/66
5,672,062 A 9/1997 Lindeman
5,704,794 A 1/1998 Lindeman
5,704,795 A 1/1998 Lindeman
5,788,512 A 8/1998 Lindeman et al.
6,062,870 A 5/2000 Hopfer, III et al.
6,094,115 A 7/2000 Nguyen et al.
6,129,555 A 10/2000 Daikuhara et al.

(Continued)

FOREIGN PATENT DOCUMENTS

JP 6-504874 6/1994

(Continued)

OTHER PUBLICATIONS

Japanese Patent Office Action with translation.

*Primary Examiner*—Thanh-Tam T Le
(74) *Attorney, Agent, or Firm*—Collard & Roe, P.C.

(57) ABSTRACT

A board-to-board assembly is disclosed, comprising a plug connector and a receptacle connector. One of the plug connector and the receptacle connector holds a signal conductor. The board-to-board assembly comprises conductive resilient members. The conductive resilient members provide electrical contacts between the signal conductor and circuit boards, respectively. No soldering process is required to the electrical contacts.

18 Claims, 15 Drawing Sheets

U.S. PATENT DOCUMENTS 7,044,748 B2 * 5/2006 Korsunsky et al. ..... 439/74

FOREIGN PATENT DOCUMENTS

| | | |
|---|---|---|
| JP | 6-505359 | 6/1994 |
| JP | 8-241762 | 9/1996 |
| JP | 8-335471 | 12/1996 |
| JP | 09-232018 | 9/1997 |
| JP | 2000-67955 | 3/2000 |
| JP | 2002-536937 | 10/2002 |
| JP | 2005-071769 | 3/2005 |
| WO | WO 92/09119 | 5/1992 |
| WO | WO 92/14280 | 8/1992 |
| WO | WO 92/14281 | 8/1992 |

* cited by examiner

CONNECTOR, MATING CONNECTOR AND BOARD-TO-BOARD CONNECTOR ASSEMBLY

BACKGROUND OF THE INVENTION

This invention relates to a board-to-board connector assembly for use in connecting two circuit boards and, particularly, to a connector and a mating connector which constitute the board-to-board connector assembly.

JP-A 2005-71769 discloses a board-to-board connector assembly comprising a plug connector and a receptacle connector, the contents of JP-A 2005-71769 being incorporated herein by reference. The plug connector is mounted on a first circuit board with its signal conductors such as terminals or contacts being soldered on a circuit pattern of the first circuit board so that the plug connector is fixed on the first circuit board. Likewise, the receptacle connector is mounted on a second circuit board with its signal conductors such as terminals or contacts being soldered on a circuit pattern of the second circuit board so that the receptacle connector is fixed on the second circuit board. Thus, all of the signal conductors of the disclosed board-to-board connector assembly are fixed to the first and the second circuit boards by using solder.

However, the solder makes it difficult to match impedance between the signal conductors and the circuit patterns of the first and the second circuit boards. The difficulty of the impedance-matching causes a problem on a high-speed signal transmission such as a differential transmission. Therefore, there is a need for a novel structure of a board-to-board connector assembly which allows easy impedance-matching between signal conductors and circuit patterns of circuit boards.

SUMMARY OF THE INVENTION

According to one aspect of the present invention, a connector comprises a lower conductive resilient member, a lower block member, a signal conductor and a main housing. The lower block member has a first upper surface and a first lower surface and is formed with a lower holder hole. The lower holder hole extends between the first upper surface and the first lower surface and holds the lower conductive resilient member so that the lower conductive resilient member projects from the first lower surface and is accessible through the first upper surface. The signal conductor has upper and lower ends. The main housing has a second upper surface and a second lower surface and is formed with a conductor holder. The main housing is mounted on the lower block member. The second lower surface is in contact with the first upper surface. The conductor holder extends between the first upper surface and the first lower surface and holds the signal conductor so that the lower end of the signal conductor is brought into contact with the lower conductive resilient member and that the upper end of the signal conductor is accessible through the second upper surface.

Likewise, the upper end of the signal conductor is brought into contact with another conductive resilient member, which is held by the connector or a mating connector matable with the connector.

The above-mentioned structure allows that the signal conductor is electrically connected to circuit patterns of circuit boards through the conductive resilient members without soldering. Therefore, it is easier than the disclosed technique to match impedance between the signal conductors and the circuit patterns of the circuit boards.

An appreciation of the objectives of the present invention and a more complete understanding of its structure may be had by studying the following description of the preferred embodiment and by referring to the accompanying drawings.

Figure 1:
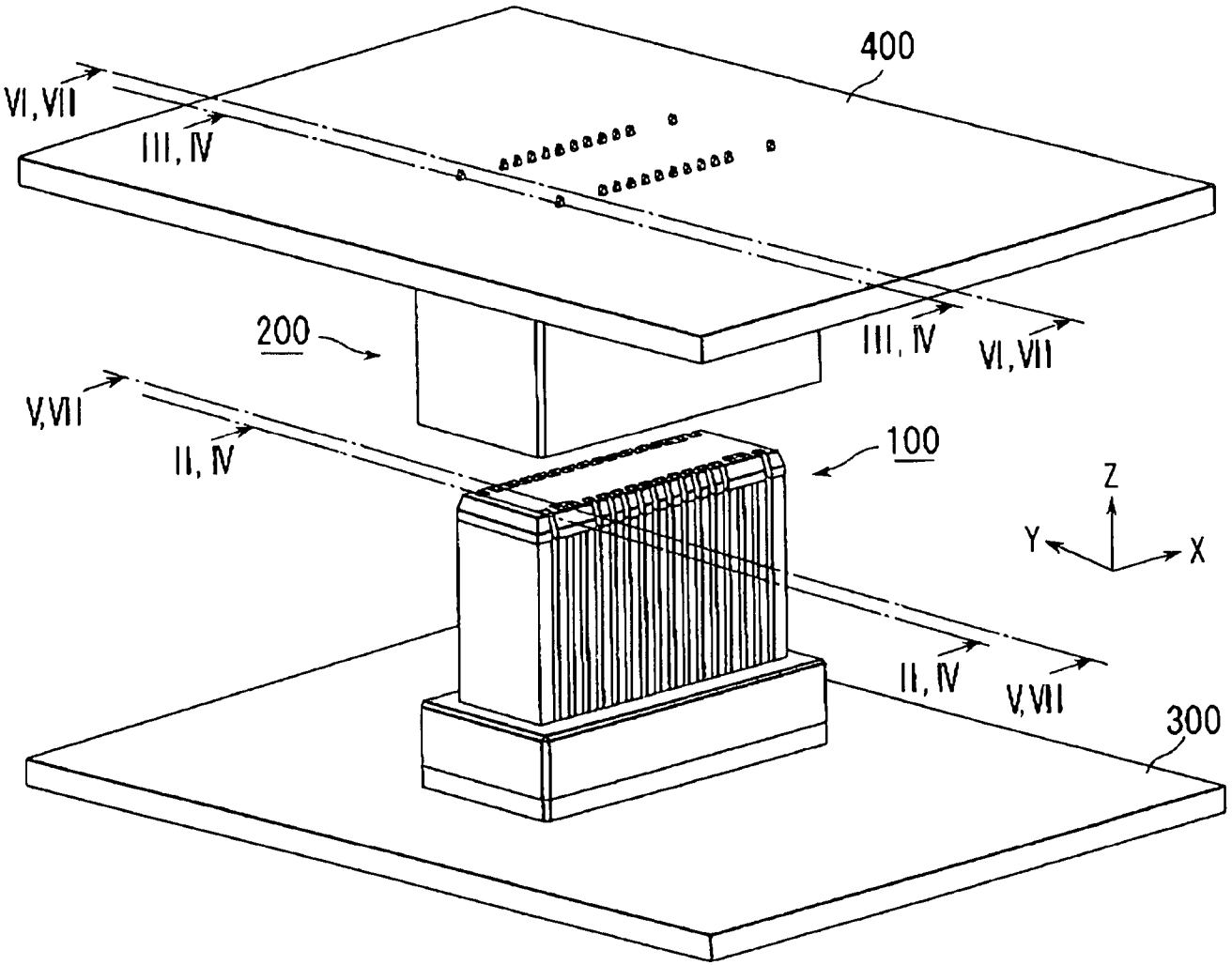
FIG. 1 is a perspective view showing a connector assembly according to an embodiment of the present invention, wherein a plug connector and a receptacle connector of the connector assembly are fixed on circuit boards, respectively, but are detached from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIGS. 1 to 8, a connector assembly according to an embodiment of the present invention comprises a plug connector 100 having a fit portion and a receptacle connector 200 having a mating fit portion into which the fit portion of the plug connector 100 is press-fit to mate the plug connector 100 with the receptacle connector 200. The plug connector 100 is mounted and fixed on a circuit board 300. The receptacle connector 200 is mounted and fixed on another circuit board 400. When the plug connector 100 is mated with the receptacle connector 200, the circuit boards 300, 400 are interconnected by the connector assembly of the plug and the receptacle connectors 100, 200.

Figure 8:
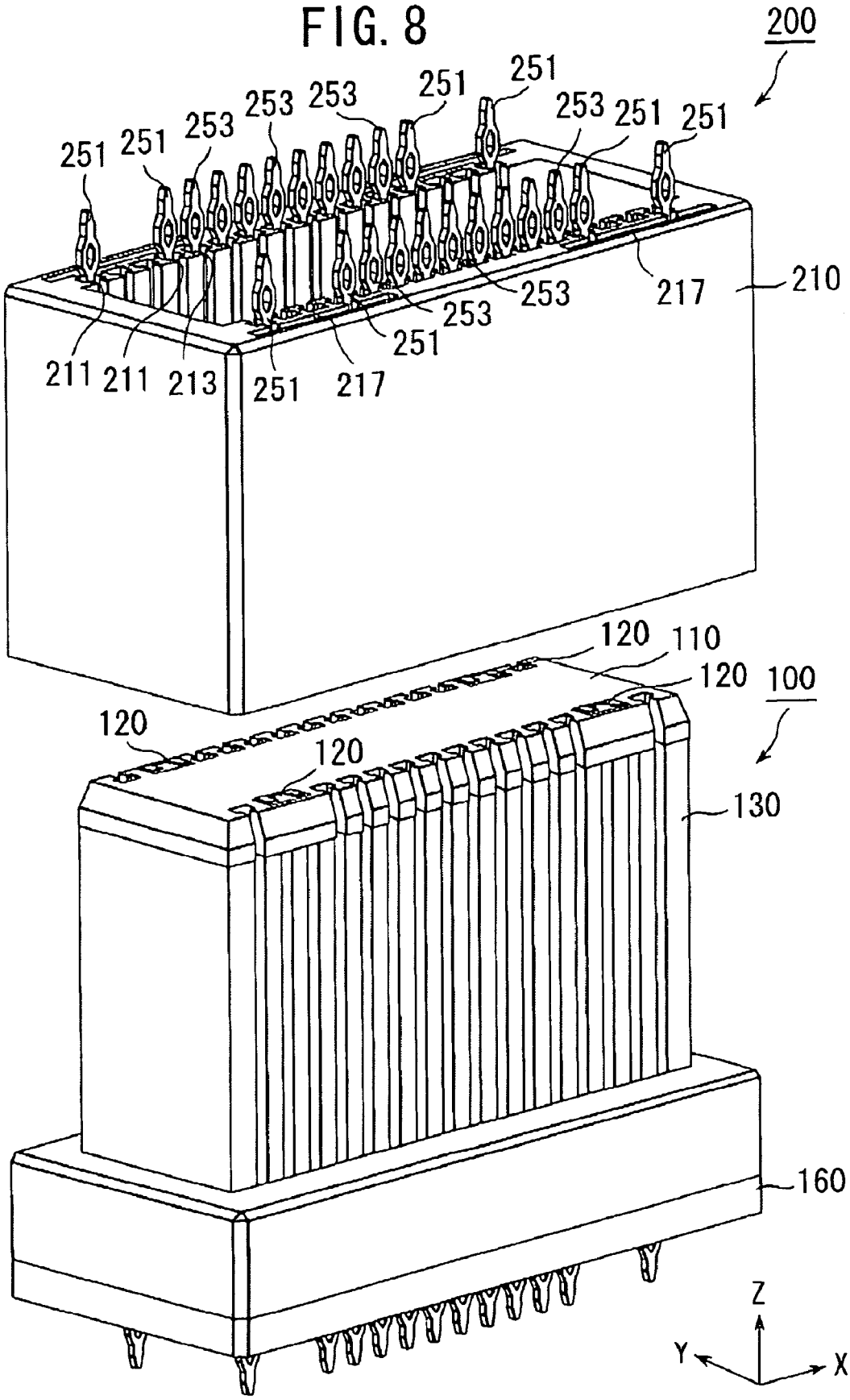
FIG. 8 is a perspective view showing the connector assembly of FIG. 1, wherein the plug connector and the receptacle connector are detached from each other.
Figure 9:
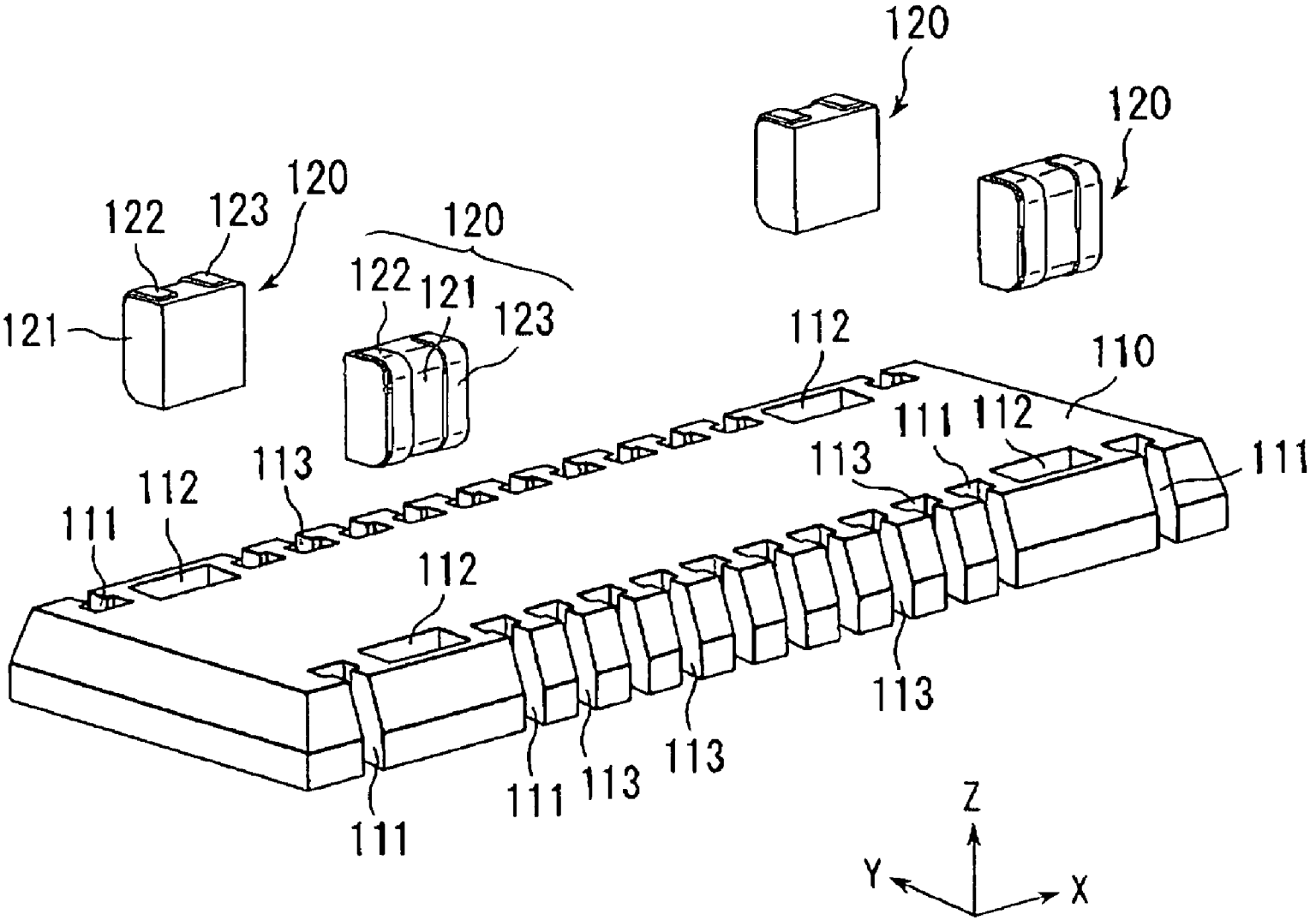
FIG. 9 is an exploded, perspective view showing an upper block member and upper conductive resilient members of the plug connector of FIG. 8.
Figure 10:
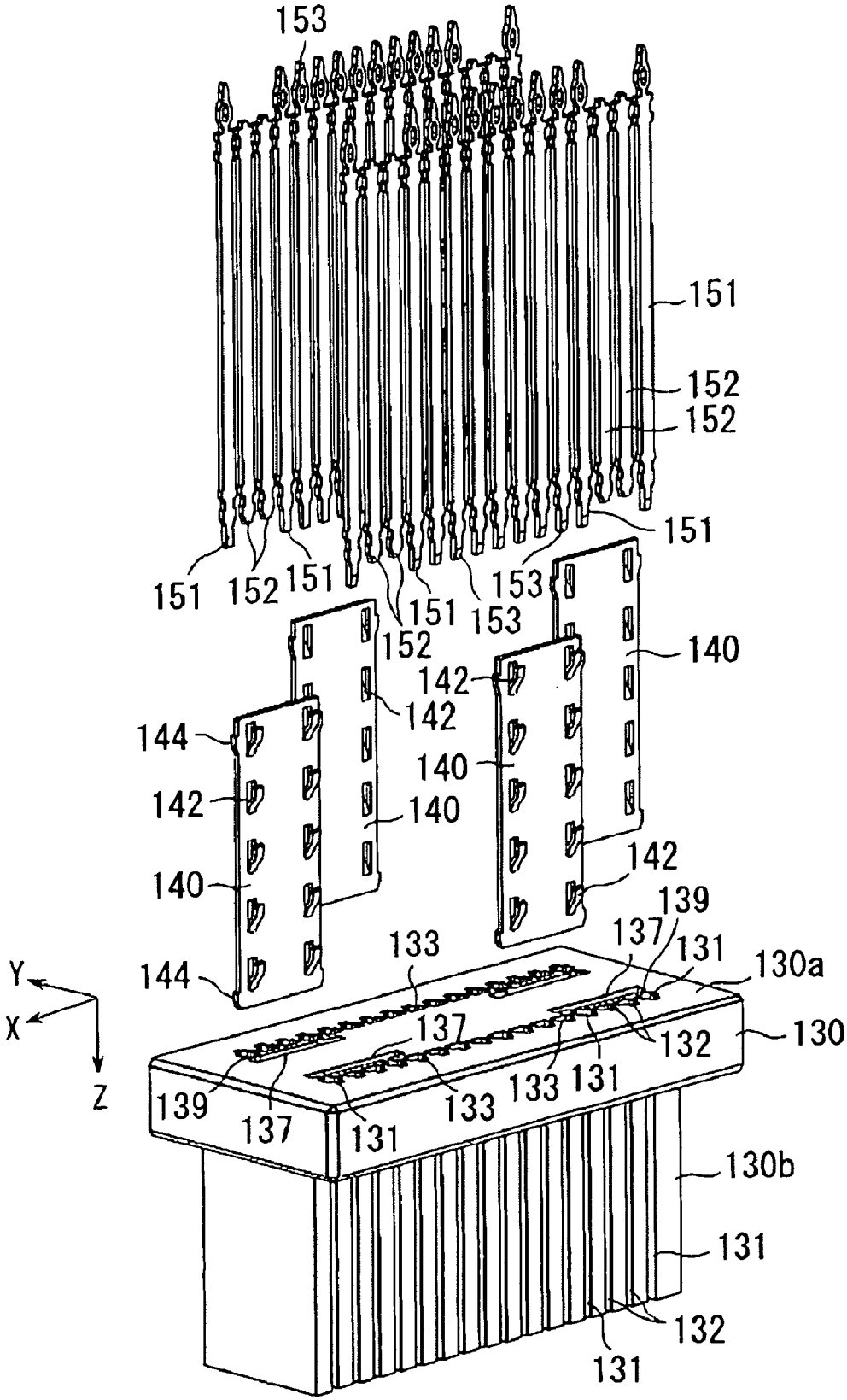
FIG. 10 is an exploded, bottom perspective view showing a main housing, ground plates, ground contacts, high speed signal conductors and low speed signal conductors of the plug connector of FIG. 8.
Figure 12:
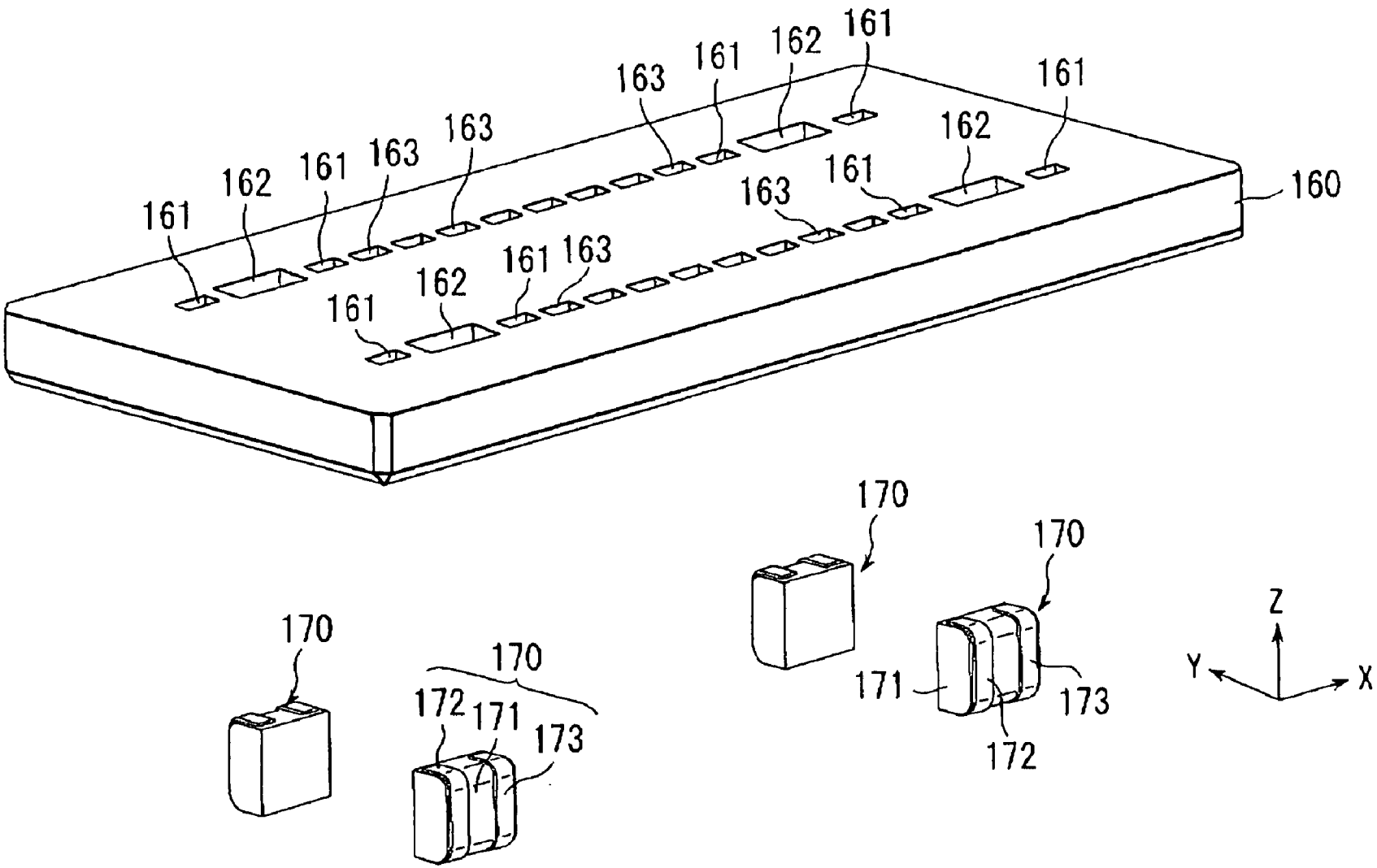
FIG. 12 is an exploded, perspective view showing a lower block member and lower conductive resilient members of the plug connector of FIG. 8.
Figure 13:
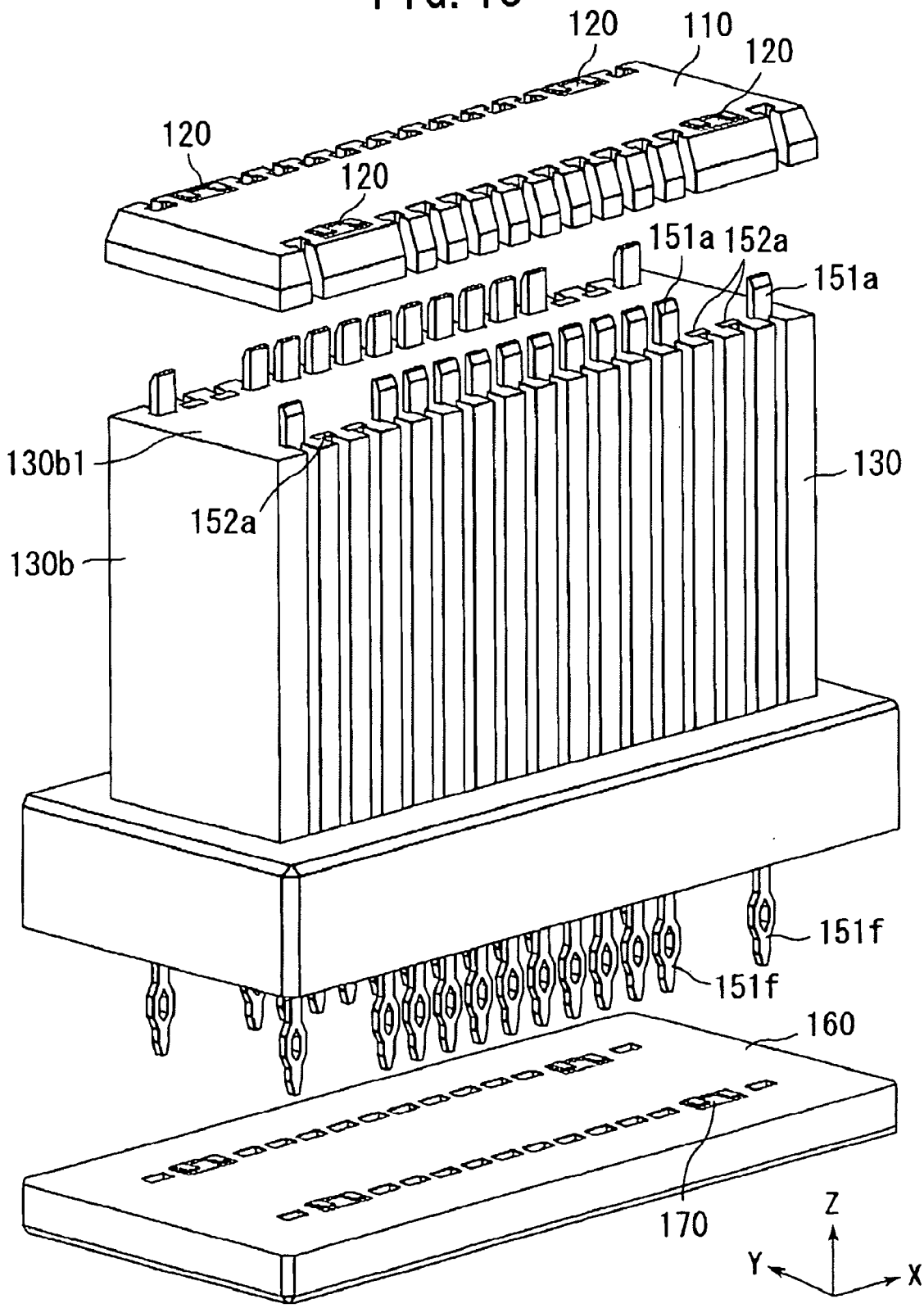
FIG. 13 is an exploded, perspective view showing the plug connector of FIG. 8.

As shown in FIGS. 8 and 13, the plug connector 100 is generally comprised of three parts, i.e. an upper part, a middle part and a lower part. As shown in FIGS. 9 and 13, the upper part of the plug connector 100 comprises an upper block member 110 and conductive resilient members 120. As shown in FIGS. 12 and 13, the lower part of the plug connector 100 comprises a lower block member 160 and conductive resilient members 170. The middle part of the plug connector 100 is a main part and, as shown in FIGS. 10 and 13, comprises a main housing 130, four ground plates 140, and two rows of contacts. Each of the contact rows comprises two pairs of ground contacts 151, two pairs of high speed signal conductors 152 and multiple low speed signal conductors 153, and they are arranged along an X-direction. Each of the ground contacts 151, the high speed signal conductors 152 and the low speed signal conductors 153 extends in a Z-direction. The high speed signal conductors 152 are adapted for high speed signal transmission, and the low speed signal conductors 153 are adapted for low speed signal transmission. More specifically, the illustrated high speed signal conductors 152 are used for differential transmission, wherein each pair of the high speed signal conductors 152 transmits a pair of differential signals. However, the present invention is not limited thereto. For example, this embodiment may be modified in consideration of a single-ended transmission scheme; each pair of the high speed signal conductors 152 and an element pair corresponding thereto may be replaced with a single high speed signal conductor and a single element corresponding thereto.

As shown in FIGS. 9 and 13, the upper block member 110 is generally a plate-like insulator block having upper beveled edges and is formed with two rows of contact-top receptions. Each of the contact-top reception rows comprises two pairs of recesses 111, two holder holes 112 and multiple recesses 113, and all of them extend between upper and lower surfaces of the upper block member 110. In addition, recesses 111 and 113 are formed accessible also in a Y-direction, as apparent from the drawings. Each of the recesses 111 is for receiving top portion of the ground contact 151. Each of the holder holes 112 is positioned between one pair of the recesses 111 and is for holding a corresponding one of the conductive resilient members 120. Each of the recesses 113 is for receiving a top portion of the low speed signal conductor 153. In this embodiment, the recesses 111 and the recesses 113 have a common shape. In addition, two of the recesses 111 and the recesses 113 are arranged between the holder holes 112 of each contact-top reception row at regular intervals, as shown in the drawings.

Each of the illustrated conductive resilient members 120 comprises a non-conductive elastic block 121 and conductive films 122, 123. The elastic block 121 has a D-like shape cross-section in the YZ plane and is made of rubber in this embodiment; the present invention is however not limited thereto but may use another material for the elastic block. Each of the conductive films 122, 123 is attached on and supported by the elastic block 121 so that the conductive film 122, 123 has a U-like shape cross-section in the YZ plane. The conductive films 122, 123 are arranged in parallel with each other in the X-direction. In this embodiment, the conductive film 122, 123 is made of copper and is formed on the elastic block by a sputtering process; the present invention is however not limited thereto, but the conductive film 122, 123 may be made of another material and/or may be formed by another method. Furthermore, the conductive resilient member 120 may be an anisotropic conductive elastomer as disclosed in JP-A H09-232018, the contents of which are incorporated herein by reference.

The conductive resilient members 120 are inserted into the holder holes 112 of the upper block member 110 and is held by the upper block member 110. In this embodiment, the height of the conductive resilient member 120 is larger than the thickness of the upper block member 110 in the Z-direction. Therefore, at least one of upper and lower parts of the conductive resilient member 120 projects from the upper block member 110 in the Z-direction.

As shown in FIGS. 8, 10 and 13, the main housing 130 has a plinth portion 130*a* and a protrusion portion 130*b* and, as best shown in FIG. 10, is formed with two rows of contact accommodation portions. Each of the contact accommodation portion rows comprises contact accommodation portions 131, conductor holders 132 and conductor accommodation portions 133. Each of the contact accommodation portions 131 is for accommodating a main portion of the ground contact 151. Each of the conductor holders 132 is for holding the high speed signal conductor 152. Each of the conductor accommodation portions 133 is for accommodating a main portion of the low speed signal conductor 153. In this embodiment, the contact accommodation portions 131, the conductor holders 132 and the conductor accommodation portions 133 have a common shape which consists of a hole formed in the plinth portion 130*a* and a recess formed in the side surface of the protrusion portion 130*b* and extends along the Z-direction. More specifically, each of the contact accommodation portions 131, the conductor holders 132 and the conductor accommodation portions 133 has a fortress model shape projecting outwardly, as seen from the bottom of the main housing 130. The contact accommodation portion rows are symmetric with respect to a center of the main housing 130 in the Y-direction.

As understood from FIGS. 2, 5, 8, 10, 13 and 14, in this embodiment, all of the contact accommodation portions 131, the conductor holders 132 and the conductor accommodation portions 133 are accessible from the outside of the protrusion portion 130*b* in the Y-direction. However, the present invention is not limited thereto. For example, the conductor holders 132 may be a continuous hole formed in the main housing 130 and be inaccessible from the outside of the protrusion portion 130*b* in the Y-direction.

In each contact accommodation portion row, the contact accommodation portions 131, the conductor holders 132 and the conductor accommodation portions 133 are arranged at regular intervals in the X-direction. More in detail, the contact accommodation portion 131, one pair of the conductor holders 132, the contact accommodation portion 131, eight of the conductor accommodation portions 133, the contact accommodation portion 131, one pair of the conductor holders 132, the contact accommodation portion 131 are arranged in this order. In order words, one pair of the conductor holders 132 are positioned between one pair of the contact accommodation portions 131.

The main housing 130 is further formed with four plate accommodation portions 137. Each of the plate accommodation portions 137 is for accommodating the ground plate 140 and is positioned nearer to the center of the plinth portion 130*a* in the Y-direction than a set of the contact accommodation portions 131 and the conductor holders 132, i.e. a pair of the contact accommodation portions 131 and a pair of the conductor holders 132.

Figure 2:
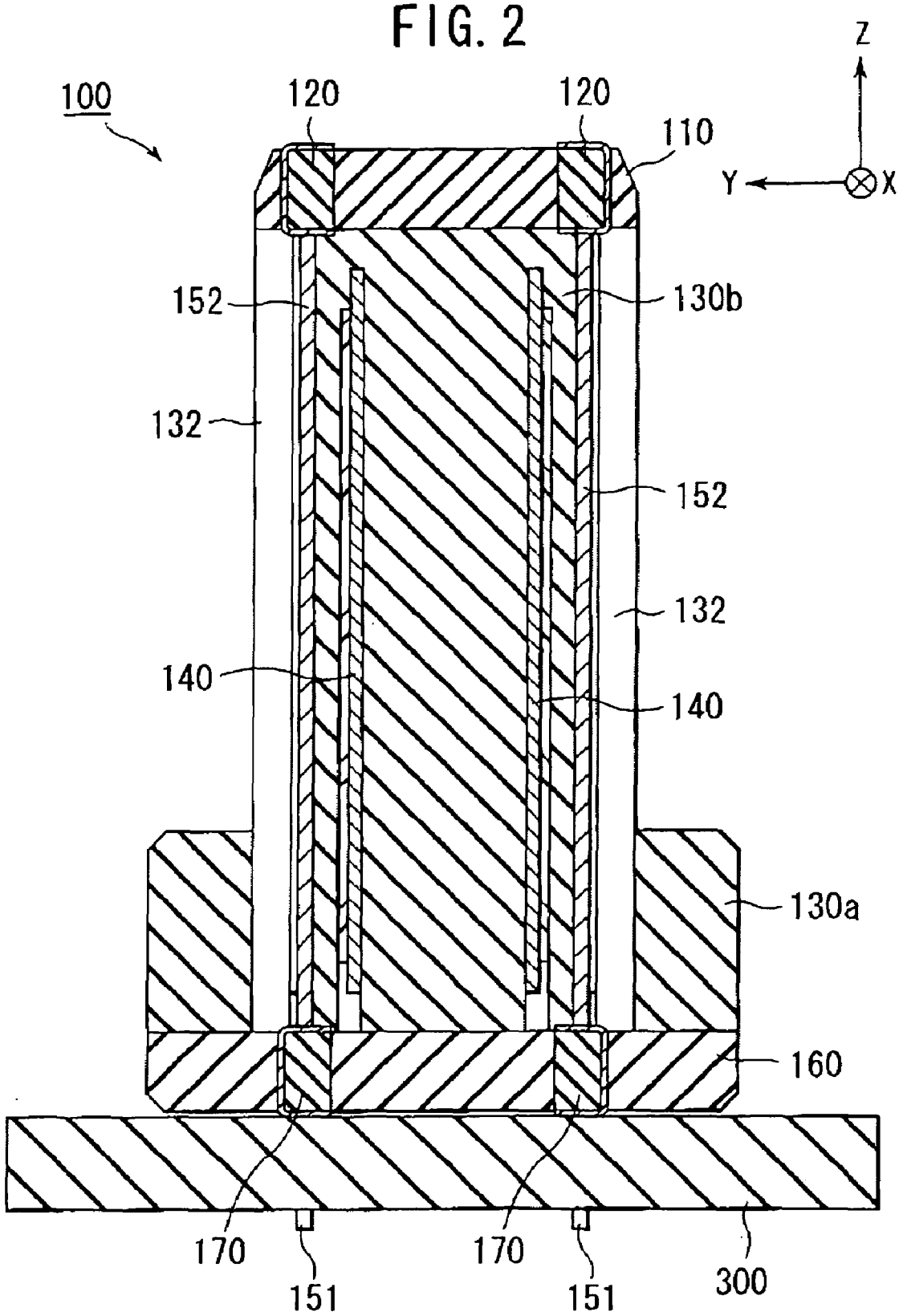
FIG. 2 is a cross-sectional view showing the plug connector of FIG. 1, taken along lines II-II of FIG. 1.
Figure 3:
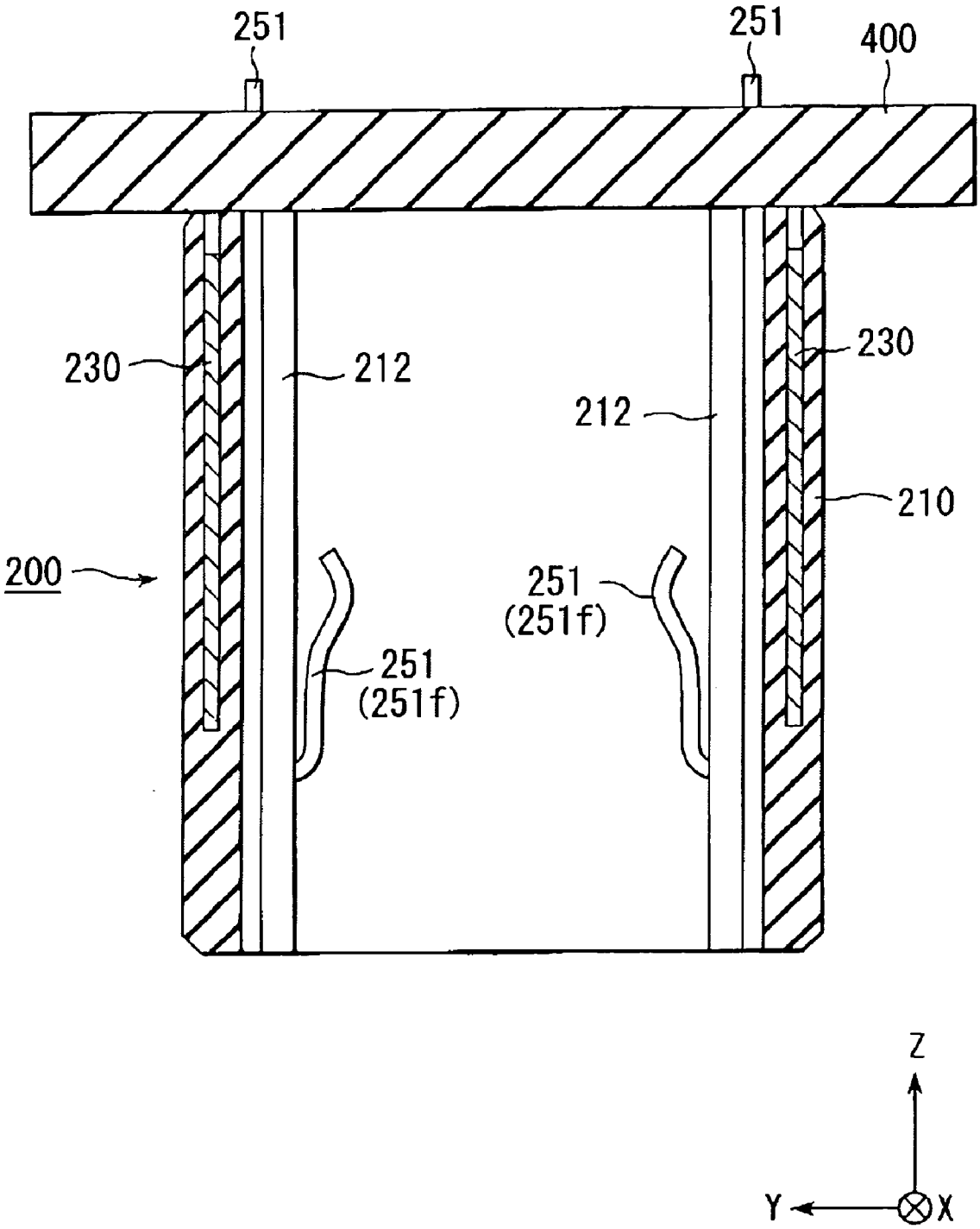
FIG. 3 is a cross-sectional view showing the receptacle connector of FIG. 1, taken along lines III-III of FIG. 1.
Figure 5:
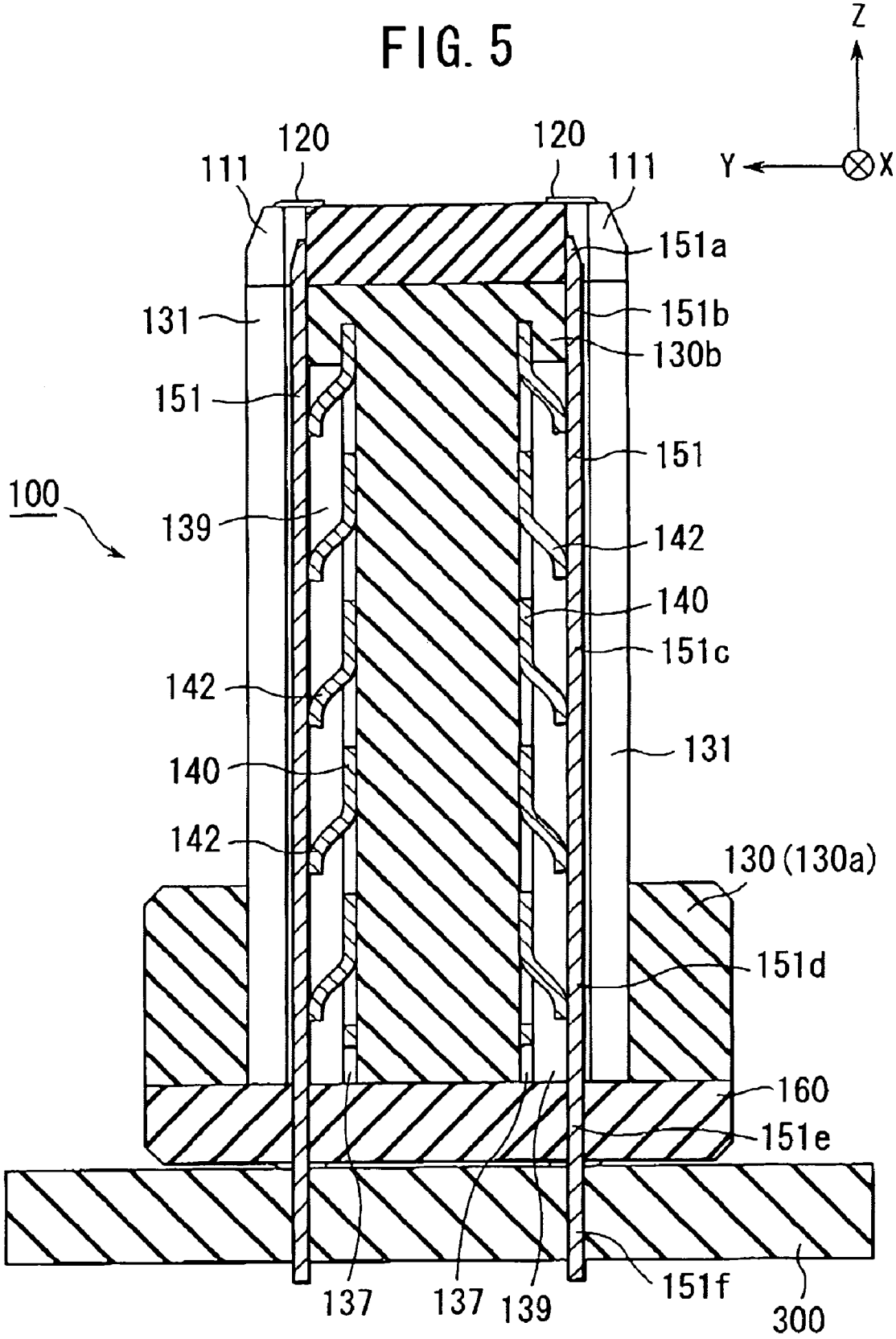
FIG. 5 is a cross-sectional view showing the plug connector of FIG. 1, taken along lines V-V of FIG. 1.

As seen from FIGS. 2, 5 and 10, each of the plate accommodation portions 137 has a slit-like shape, which extends in the Z-direction but, as best shown in FIG. 5, does not pierce the main housing 130 in this embodiment. As seen from FIGS. 5 and 10, each of the plate accommodation portions 137 and a corresponding pair of the contact accommodation portions 131 are coupled with each other in the Y-direction by communication portions 139. In this embodiment, a thickness between the plate accommodation portion 137 and each of the conductor holders 132 corresponding thereto is thinner than another thickness between the conductor holder 132 and the contact accommodation portion 131 nearest thereto.

Figure 11:
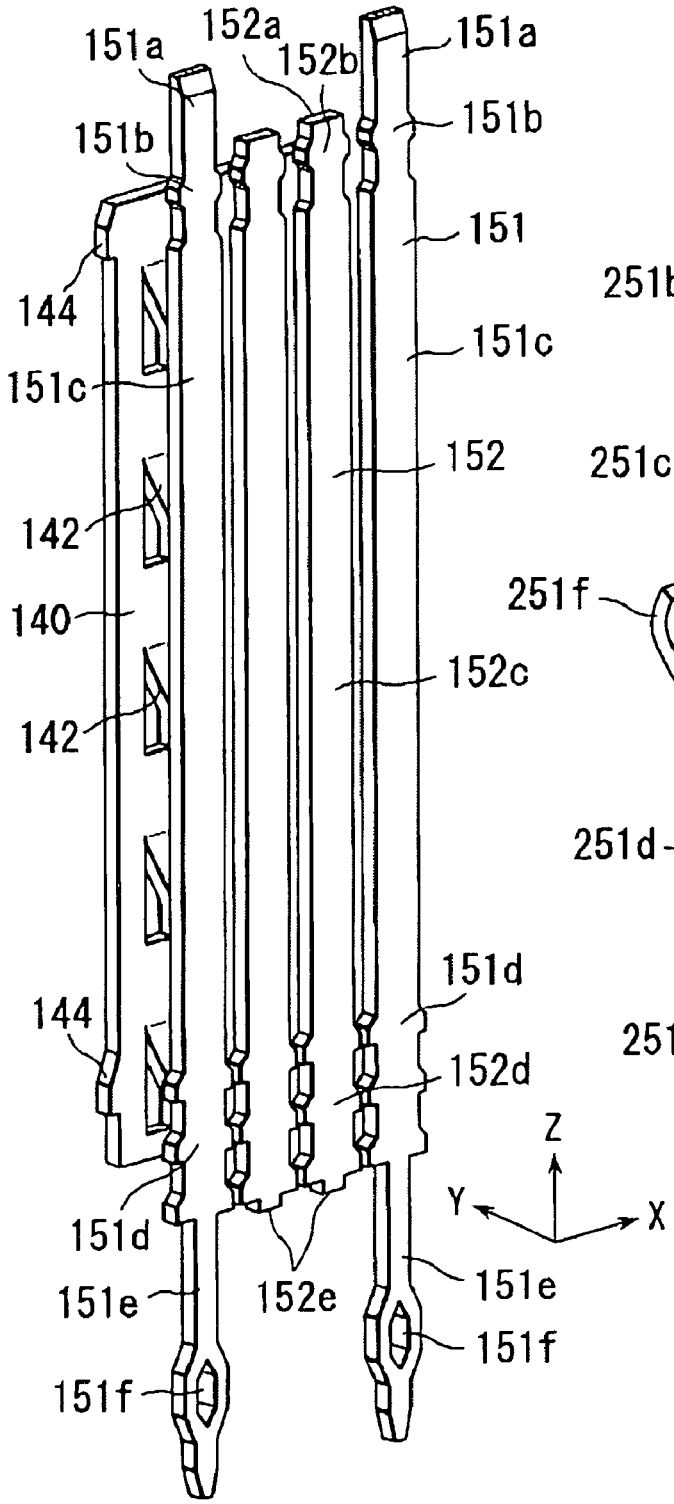
FIG. 11 is a perspective view showing a set of the ground plate, the ground contacts and the high speed signal conductors of FIG. 10.

With reference to FIGS. 10 and 11, each of the ground plates 140 generally has a flat-plate shape, on which two columns of tongue pieces 142 are formed. Each column is comprised of five tongue pieces 142 and corresponds to one of the communication portions 139 and, accordingly, one of the contact accommodation portions 131. Each of the illustrated tongue pieces 142 is formed by making a rectangular U-shaped cut into a mother material of the ground plate 140, followed by bending the cut part.

Each of the ground plates 140 is further provided with four press-fit barbs 144, which are positioned near the respective corners of the ground plate 140 and project outwardly from the ground plate 140 in the X-direction.

The ground plates 140 are inserted into the respective plate accommodation portions 137 with the tongue pieces 142 passing through the respective communication portions 139. The inserted ground plates 140 are prevented from undesirably falling out of the main housing 130 by the press-fit barbs 144.

With reference to FIG. 10, the ground contacts 151 and the low speed signal conductors 153 have a common shape which is a narrow plate extending in the Z-direction. Each of the high speed signal conductors 152 has a particular shape obtainable by cutting the top portion and the bottom portion of the ground contact 151 off. As mentioned above, there are two contact rows, in each of which the ground contact 151, one pair of the high speed signal conductors 152, the ground contact 151, eight of the low speed signal conductors 153, the ground contact 151, one pair of the high speed signal conductors 152, the ground contact 151 are arranged in this order in the X-direction.

With reference to FIG. 11, each of the ground contacts 151 is comprised of a top portion 151*a*, a fit portion 151*b*, a main portion 151*c*, a fit portion 151*d*, a neck portion 151*e*, and a fit portion 151*f*. The illustrated fit portion 151*b* projects outwardly in the X-direction. Likewise, the illustrated fit portion 151*d* projects outwardly in the X-direction; the illustrated fit portion 151*d* has more projections than the illustrated fit portion 151*b*. The fit portions 151*b* and 151*d* are adapted to be press-fit into and be held by the contact accommodation portion 131. The main portion 151*c* extends straightly between the fit portions 151*b* and 151*d* in the Z-direction. The neck portion 151*e* is narrowerthan the other portions and has about a half of the width of the fit portion 151*b* in this embodiment. The fit portion 151*f* is adapted to be press-fit into a fit hole formed in the circuit board 300.

As apparent from FIGS. 10, 11 and 13, the ground contact 151 is inserted from the bottom of the main housing 130 into the contact accommodation portion 131 of the main housing 130, especially, a rectangular base portion of the contact accommodation portion 131 extending in the X-direction, so that the fit portions 151*b*, 151*d* are press-fit into the contact accommodation portion 131, and thereby, that the fit portion 151*b* to the fit portion 151*d* are held by the main housing 130. The press-fit of the fit portions 151*b*, 151*d* to the contact accommodation portion 131 prevents the ground contact 151 from undesirably falling out of the main housing 130.

As best shown in FIG. 13, the top portion 151*a* projects upwardly from the main housing 130, especially, from an upper surface 130*b*1 of the protrusion portion 130*b*. Likewise, the neck portion 151*e* and the fit portion 151*f* project downwardly from the plinth portion 130*b* of the main housing 130.

As described above, the low speed signal conductor 153 has a shape same as that of the ground contact 151, and the conductor accommodation portion 133 has a structure same as that of the contact accommodation portion 131. Therefore, the low speed signal conductor 153 is partially accommodated in and held by the main housing 130 in a manner similar to the ground contact 151.

Note here that, as apparent from FIGS. 5 and 11, the ground contacts 151 are electrically and physically coupled with the tongue pieces 142 of the ground plate 140 in this embodiment.

With reference to FIG. 11, the high speed signal conductor 152 is comprised of an upper end 152*a*, a fit portion 152*b*, a main portion 152*c*, a fit portion 152*d* and a lower end 152*e*. In this embodiment, the fit portion 152*b*, the main portion 152*c* and the fit portion 152*d* are same as the fit portion 151*b*, the main portion 151*c* and the fit portion 151*d* of the ground contact 151, respectively. In this embodiment, the fit portions 152*b*, 152*d* are press-fit into the conductor holder 132 so that the upper end 152*a* is laid on a plane same as the upper surface 130*b*1 of the main housing 130, and that the lower end 152*e* is laid on a plane same as a lower surface of the main housing 130. Thus, the high speed signal conductor 152 is held by the main housing 130 so that the upper and the lower ends 152*a*, 152*e* are accessible from the upper and the lower surfaces of the main housing 130.

In this embodiment, the minimum distance between the ground plate 140 and each of the high speed signal conductors 152 is shorter than the minimum distance between one of the ground contacts 151 and one of the high speed signal conductors 152 because of the arrangement of the contact accommodation portions 131, the conductor holders 132 and the plate accommodation portion 137 as mentioned above. Therefore, characteristic impedance of a transmission path of the high speed transmission is mainly determined by the relation between the ground plate 140 and the high speed signal conductor 152.

As shown in FIGS. 12 and 13, the lower block member 160 is generally a plate-like insulator block having lower beveled edges and is formed with two rows of contact-neck receptions. Each of the contact-neck reception rows comprises two pairs of reception holes 161, two holder holes 162 and multiple reception holes 163. All of them extend between upper and lower surfaces of the lower block member 160. Each of the reception holes 161 is for receiving the neck portion 151*e* of the ground contacts 151. Each of the holder holes 162 is positioned between one pair of the reception holes 161 and is for holding a corresponding one of the conductive resilient members 170. Each of the reception holes 163 is for receiving the neck portion of the low speed signal conductors 153. In this embodiment, the reception holes 161 and the reception holes 163 have a common shape. In addition, two of the reception holes 161 and the reception holes 163 are arranged between the holder holes 162 of each contact-neck reception row at regular intervals, as shown in the drawings. As apparent from FIGS. 5 and 8, the fit portion 151*f* projects downwardly from the lower surface of the lower block member 160 in the Z-direction. Likewise, the fit portion of the low speed signal conductor 153 projects downwardly from the lower surface of the lower block member 160.

With reference to FIGS. 9 and 12, each of the conductive resilient members 170 of the present embodiment has a structure same as that of the conductive resilient member 120. Namely, each of the conductive resilient members 170 has an elastic block 171 and conductive films 172, 173 attached to the elastic block 171. The illustrated conductive resilient members 170 may be modified and changed as explained about the conductive resilient member 120. In this embodiment, the height of the conductive resilient member 170 is larger than the thickness of the lower block member 160 in the Z-direction.

The conductive resilient members 170 are inserted into the holder holes 162 of the lower block member 160 and is held by the lower block member 160. In this embodiment, at least one of upper and lower parts of the conductive resilient member 170 projects from the lower block member 160 in the Z-direction.

Figure 14:
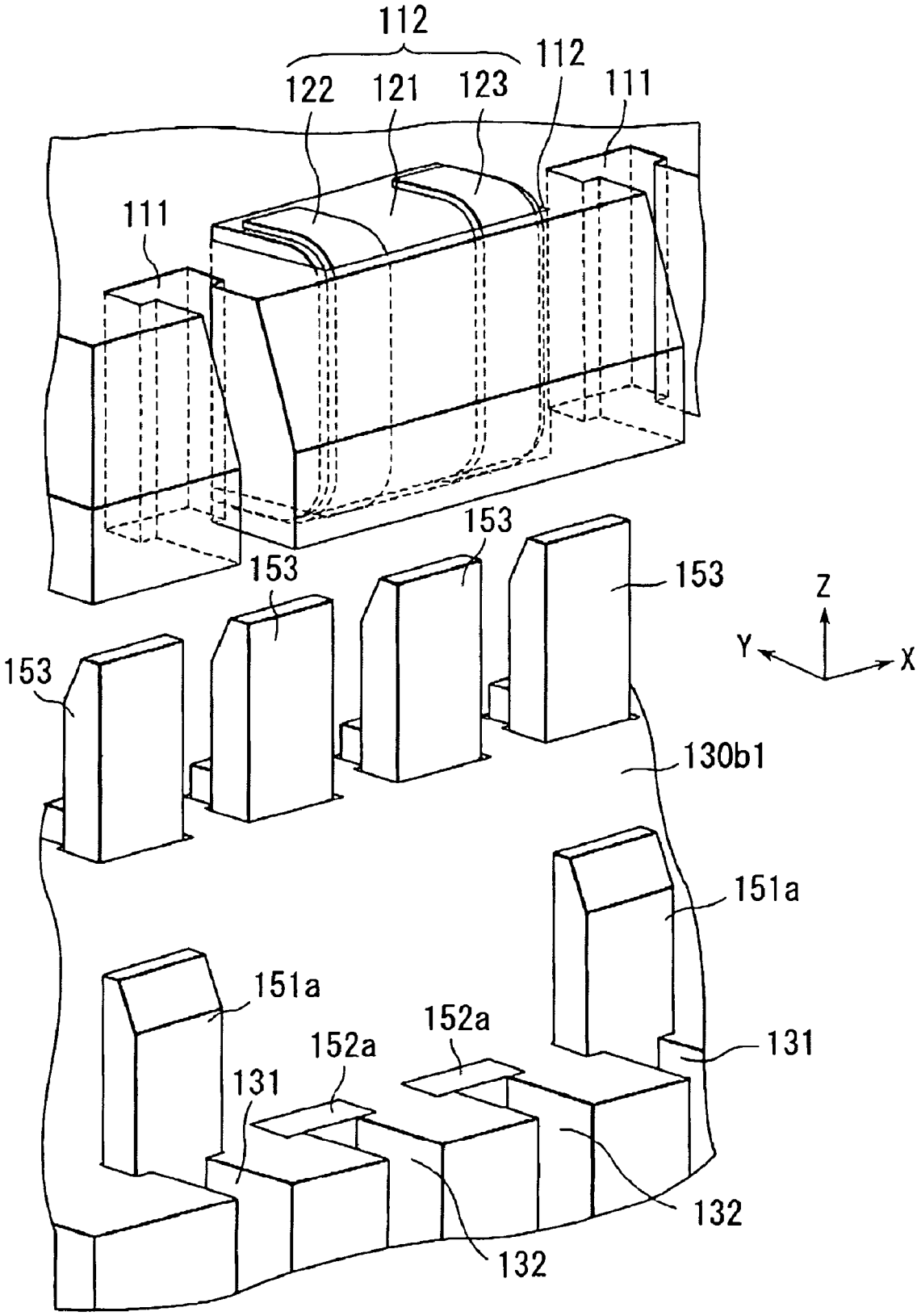
FIG. 14 is a partial, enlarged, perspective view showing upper ends of the high speed signal conductors and their surroundings of the plug connector of FIG. 13.

The thus obtained set of the upper part, the middle part and the lower part are combined so that the conductive films 122, 123 are brought into contact with the upper ends 152*a* of the high speed signal conductors 152, respectively, and that the conductive films 172, 173 are brought into contact with the lower ends 152*e* of the high speed signal conductors 152, respectively, as understood from FIGS. 11, 13 and 14. In addition, each of the conductive films 122, 123 projects upwardly from the upper surface of the upper block member 110 while each of the conductive films 172, 173 projects downwardly from the lower surface of the lower block member 160, as best show in FIG. 2. The size of the projection of each conductive resilient member 170 is selected to ensure a reliable contact between each conductive resilient member 170 and a circuit pattern formed on the circuit board 300 when the plug connector 100 is mounted and fixed on the circuit board 300. More in detail, the projections of the illustrated conductive films 172, 173 provide reliable electrical connections between the conductive films 172, 173 and the circuit pattern of the circuit board 300 without soldering. Likewise, the size of the projection of each conductive resilient member 120 is selected to ensure a reliable contact between each conductive resilient member 120 and another circuit pattern formed on the circuit board 400 when the plug. connector 100 is mated with the receptacle connector 200. More in detail, the projections of the illustrated conductive films 122, 123 provide reliable electrical connections between the conductive films 122, 123 and the circuit pattern of the circuit board 400 without soldering.

In this embodiment, each of the ground contacts 151 has a fit portion 151*f*, and each of the low speed signal conductors 153 has a similar fit portion, as mentioned above. The fit portions 151*f* of the ground contacts 151 and the fit portions of the low speed signal conductors 153 are press-fit into the fit holes of the circuit board 300 so that the ground contacts 151 and the low speed signal conductors 153 are electrically coupled to the circuit pattern of the circuit board 300 without soldering.

Figure 15:
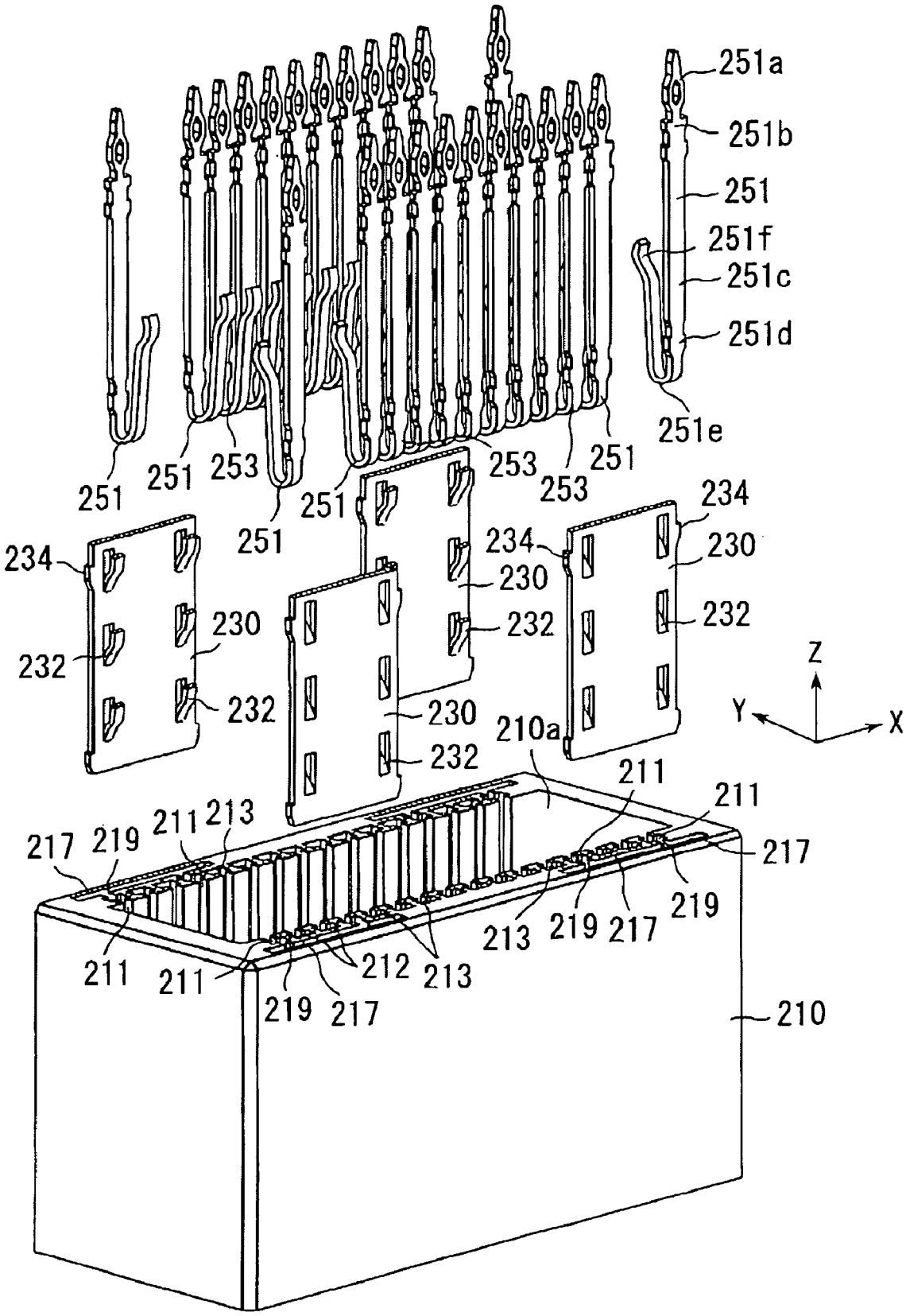
FIG. 15 is an exploded, perspective view showing the receptacle connector of FIG. 8.

With reference to FIGS. 8 and 15, the receptacle connector 200 comprises a housing 210, four ground plates 230 and two rows of contacts. Each of the contact rows comprises two pairs of ground contacts 251 and eight low speed signal conductors 253. The ground contacts 251 correspond to the ground contacts 151, respectively. The low speed signal conductors 253 correspond to the low speed signal conductors 153, respectively. However the receptacle connector 200 does not comprise any contacts corresponding to the high speed signal conductors 152 in this embodiment.

The housing 210 has a rectangular hollow shape and generally constitutes the profile of the mating fit portion of the receptacle connector 200. The housing 210 is formed with two rows of contact accommodation portions. Each of the contact accommodation portion rows comprises contact accommodation portions 211, dummy accommodation portions 212 and conductor accommodation portions 213. Each of the contact accommodation portions 211 is for accommodating the ground contact 251. Each of the conductor accommodation portions 213 is for accommodating the low speed signal conductor 253.

In this embodiment, the contact accommodation portions 211 and the conductor accommodation portions 213 have a common shape which consists of a recess formed in the inner side surface of the housing 210 and extends along the Z-direction. More specifically, each of the contact accommodation portions 211 and the conductor accommodation portions 213 has a fortress model shape projecting inwardly, as seen from the top of the housing 210. The contact accommodation portion rows are symmetric with respect to a center of the housing 210 in the Y-direction.

The illustrated dummy accommodation portions 212 have a shape same as the common shape of the contact accommodation portions 211 and the conductor accommodation portions 213 but do not accommodate any contacts, because there is no high speed signal contact for the receptacle connector 200. The illustrated dummy accommodation portions 212 may be omitted.

As understood from FIGS. 3, 6, 8 and 15, tip portions of the contact accommodation portions 211, the dummy accommodation portions 212 and the conductor accommodation portions 213 reach an inside space 210*a* of the housing 210. In other words, each of the contact accommodation portions 211, the dummy accommodation portions 212 and the conductor accommodation portions 213 continues to the inside space 210*a*. Thus, the contact accommodation portions 211, the dummy accommodation portions 212 and the conductor accommodation portions 213 are accessible from the inside space 210*a* in the Y-direction. The arrangement order of the contact accommodation portions 211, the dummy accommodation portions 212 and the conductor accommodation portions 213 is same as that of the contact accommodation portions 131, the conductor holders 132 and the conductor accommodation portions 133 of the main housing 130 of the plug connector 100.

The housing 210 is further formed with four plate accommodation portions 217. Each of the plate accommodation portions 217 is for accommodating the ground plate 230 and is positioned nearer to the outer side surfaces of the housing 210 in the Y-direction than a set of the contact accommodation portions 211 and the dummy accommodation portions 212, i.e. a pair of the contact accommodation portions 211 and a pair of the dummy accommodation portions 212.

Figure 6:
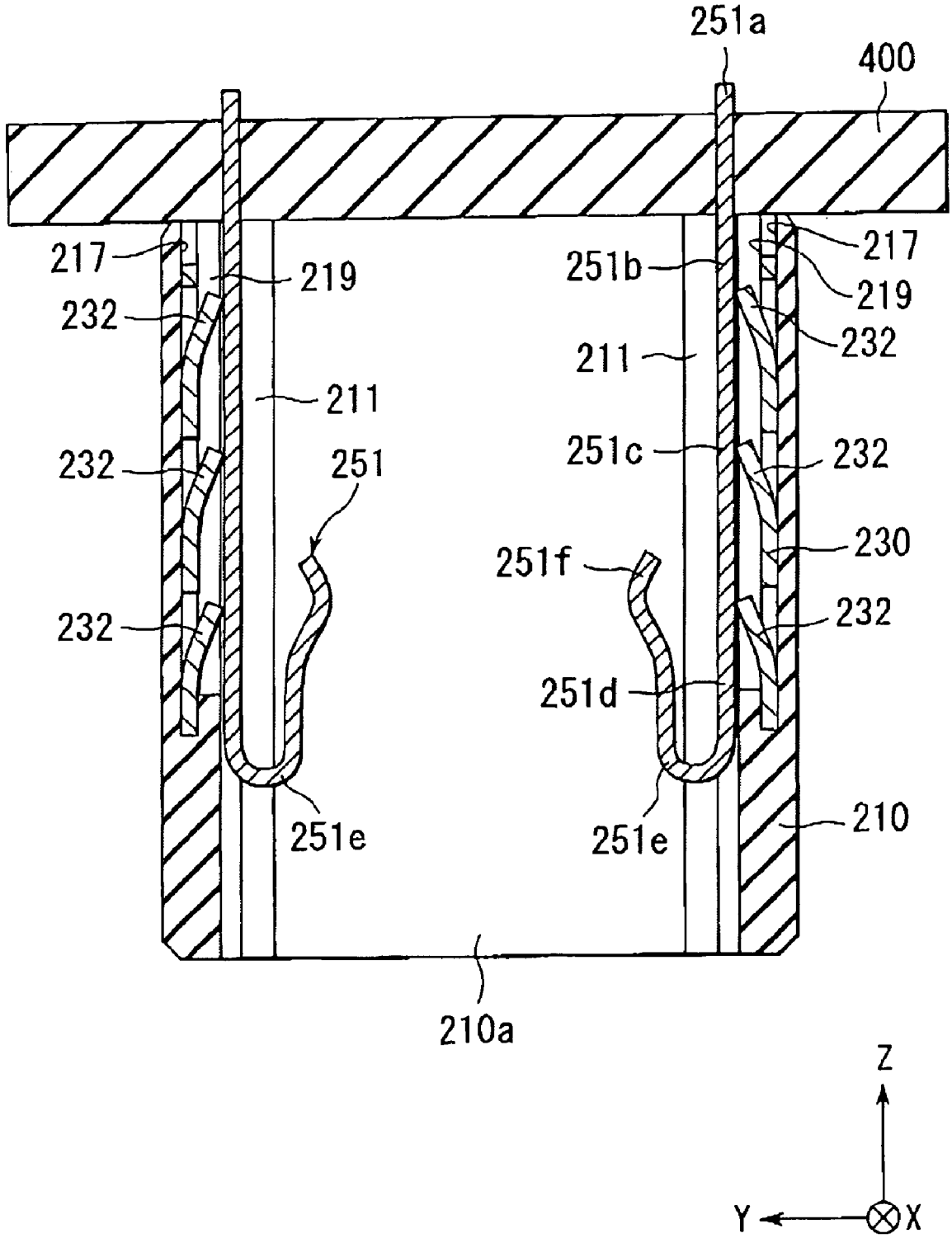
FIG. 6 is a cross-sectional view showing the receptacle connector of FIG. 1, taken along lines VI-VI of FIG. 1.

As seen from FIGS. 3, 6, 8 and 15, each of the plate accommodation portions 217 has a slit-like shape, which extends in the Z-direction but, as best shown in FIG. 6. does not pierce the housing 210 in this embodiment. As seen from FIGS. 6 and 8, each of the plate accommodation portions 217 and a corresponding pair of the contact accommodation portions 211 are coupled with each other in the Y-direction by communication portion 219.

Figure 4:
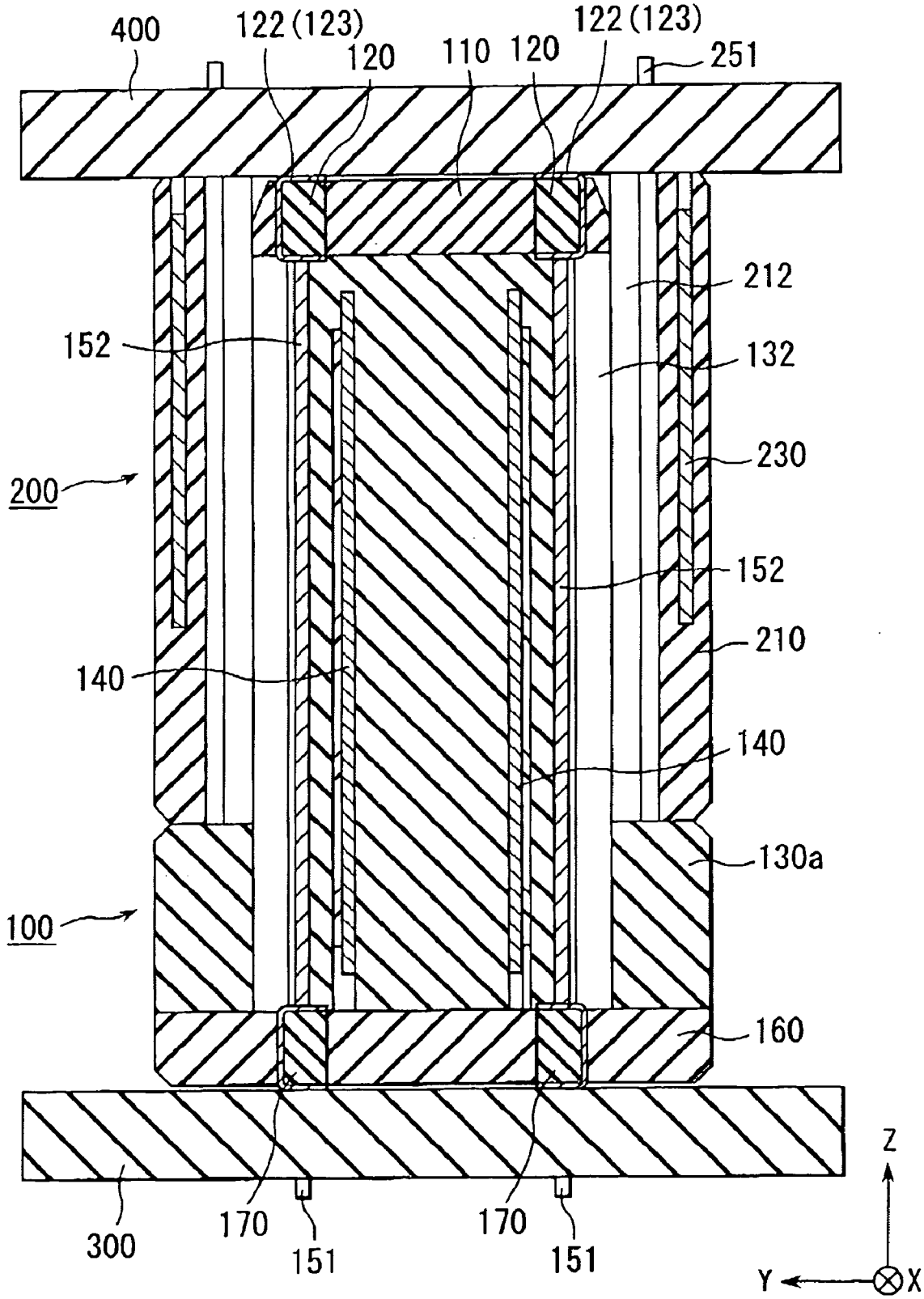
FIG. 4 is a cross-sectional view showing the connector assembly of FIG. 1, wherein the plug connector of FIG. 2 and the receptacle connector of FIG. 3 are mated with each other.
Figure 7:
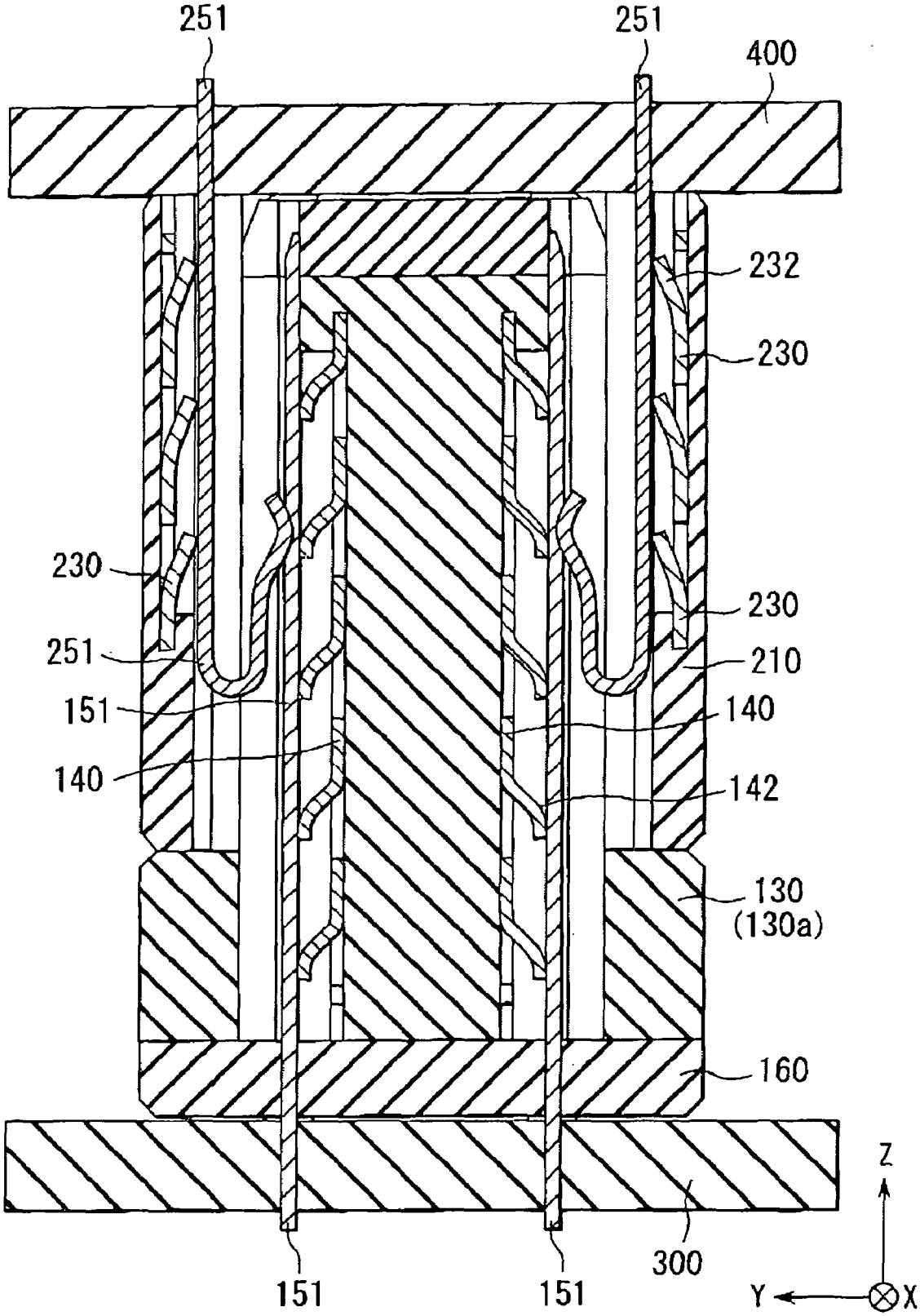
FIG. 7 is a cross-sectional view showing the connector assembly of FIG. 1, wherein the plug connector of FIG. 5 and the receptacle connector of FIG. 6 are mated with each other.

The height of the housing 210 in the Z-direction is selected so that the conductive resilient members 120 of the plug connector 100 are suitably brought into contact with the circuit pattern of the circuit board 400 when the plug connector 100 is mated with the receptacle connector 200, as shown in FIGS. 4 and 7. More specifically, the size of the housing 210 in the Z-direction is preferably equal to or smaller than the sum of the size of the protrusion portion 130*b* of the main housing 130 and the thickness of the upper block member 110 in the Z-direction.

Figure 16:
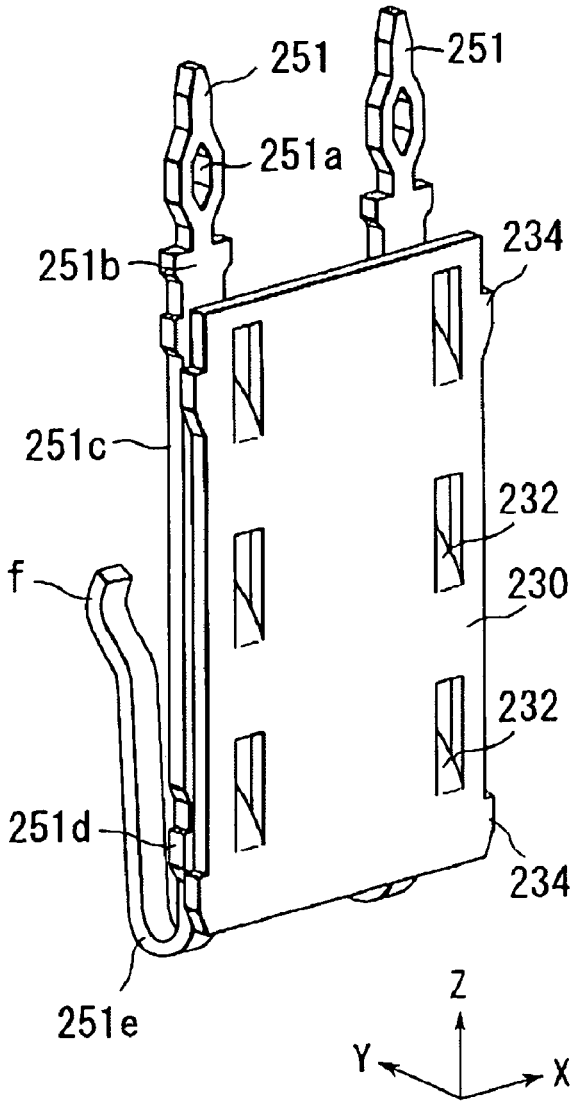
FIG. 16 is a perspective view showing a set of a ground plate and ground contacts of FIG. 15.

With reference to FIGS. 15 and 16, each of the ground plates 230 generally has a flat-plate shape, on which two columns of tongue pieces 232 are formed. Each column is comprised of three tongue pieces 232 and corresponds to one of the communication portions 219 and, accordingly, one-of the contact accommodation portions 211. Each of the illustrated tongue pieces 232 is formed by making a rectangular U-shaped cut into a mother material of the ground plate 230, followed by bending the cut part.

Each of the ground plates 230 is further provided with four press-fit barbs 234, which are positioned near the respective corners of the ground plate 230 and project outwardly from the ground plate 230 in the X-direction.

The ground plates 230 are inserted into the respective plate accommodation portions 217 with the tongue pieces 232 passing through the respective communication portions 219. The inserted ground plates 230 are prevented from undesirably falling out of the housing 210 by the press-fit barbs 234.

With reference to FIG. 15, the ground contacts 251 and the low speed signal conductors 253 have a common shape. The arrangement order of the ground contacts 251 and the low speed signal conductors 253 is similar to that of the ground contacts 151 and the low speed signal conductors 153 of the plug connector 100 but is different in that there is no contact corresponding to the high speed signal conductor 152 in the receptacle connector 200.

With reference to FIGS. 15 and 16, each of the ground contacts 251 is comprised of a fit portion 251*a*, a fit portion 251*b*, a main portion 251*c*, a fit portion 251*d*, a resilient portion 251*e*, and a contact portion 251*f*. The fit portion 251*a* is adapted to be press-fit into a fit hole formed in the circuit board 400. The illustrated fit portion 251*b* projects outwardly in the X-direction. Likewise, the illustrated fit portion 251*d* projects outwardly in the X-direction. The fit portions 251*b* and 251*d* are adapted to be press-fit into and be held by the contact accommodation portion 211. The main portion 251*c* extends straightly between the fit portions 251*b* and 251*d* in the Z-direction. The resilient portion 251*e* is formed by bending back a metal blank and elastically supports the contact portion 251*f*. The contact portion 251*f* is designed and formed to be brought into contact with the ground contact 151 when the plug connector 100 is mated with the receptacle connector 200.

As apparent from FIGS. 15 and 16, the ground contact 251 is inserted into the contact accommodation portion 211 of the housing 210, especially, a rectangular base portion of the contact accommodation portion 211 extending in the X-direction, so that the fit portions 251*b*, 251*d* are press-fit into the contact accommodation portion 211, and thereby, that the fit portion 251*b* to the fit portion 251*d* are held by the housing 210. The press-fit of the fit portions 251*b*, 251*d* to the contact accommodation portion 211 prevents the ground contact 251 from undesirably falling out of the housing 210.

As best shown in FIG. 8, the fit portion 251*a* projects upwardly from the housing 210. The contact portion 251*f* projects inwardly from the housing 210, i.e. into the inside space 210*a* of the housing 210. As described above, the low speed signal conductor 253 has a shape same as that of the ground contact 251, and the conductor accommodation portion 213 has a structure same as that of the contact accommodation portion 211. Therefore, the low speed signal conductor 253 is partially accommodated in and held by the housing 210 in a manner similar to the ground contact 251.

Note here that, as apparent from FIGS. 6 and 16, the ground contacts 251 are electrically and physically coupled with the tongue pieces 232 of the ground plate 230 in this embodiment.

In this embodiment, each of the ground contacts 251 has the fit portion 251*a*, and each of the low speed signal conductors 253 has a similar fit portion, as mentioned above. The fit portions 251*a* of the ground contacts 251 and the fit portions of the low speed signal conductors 253 are press-fit into the fit holes of the circuit board 400 so that the ground contacts 251 and the low speed signal conductors 253 are electrically coupled to the circuit pattern of the circuit board 400 without soldering.

When the plug connector 100 is mated with the receptacle connector 200, the contact portions 251*f* of the ground contacts 251 and the contact portions of the low speed signal conductors 253 slide on the main portions 151*c* of the ground contacts 151 and the main portions of the low speed signal conductors 153 so that the ground contacts 151 and the low speed signal conductors 153 are electrically and physically coupled with the ground contacts 251 and the low speed signal conductors 253, respectively. In addition, the contact portions 251*f* of the ground contacts 251 and the contact portions of the low speed signal conductors 253 catch the main portions 151*c* of the ground contacts 151 and the main portions of the low speed signal conductors 153 by using the resilient portions 251*e* of the ground contacts 251 and the resilient portions of the low speed signal conductors 253 in the mated state of the plug connector 100 and the receptacle connector 200. Therefore, the mated state is suitably kept.

Note here that one pair of the high speed signal conductors 152 are surrounded by the ground plate 140, one pair of the ground contacts 151, one pair of the ground contacts 251 and the ground plate 230 in the XY plane and are positioned away from the low speed signal conductors 153, 253, so that the high speed signal conductors 152 are shielded.

Although the conductor holders 132 of the main housing 130 are accessible in the Y-direction in the above-mentioned embodiment, they may be inaccessible in the Y-direction. Although the plug connector 100 is generally comprised of the upper part, the middle part and the lower part in the above-mentioned embodiment, the plug connector 100 may be comprised of the middle part and the lower part while the upper part may be included in the receptacle connector. In addition, although the high speed signal conductors 152 are held by the plug connector 100 in the above-mentioned embodiment, the high speed signal conductors may be held by the receptacle connector 200.

The present application is based on Japanese patent applications of JP2005-332231 filed before the Japan Patent Office on Nov. 16, 2005, the contents of which are incorporated herein by reference.

While there has been described what is believed to be the preferred embodiment of the invention, those skilled in the art will recognize that other and further modifications may be made thereto without departing from the sprit of the invention, and it is intended to claim all such embodiments that fall within the true scope of the invention.

What is claimed is:

1. A connector comprising:

a lower conductive resilient member;

a lower block member having a first upper surface and a first lower surface and being formed with a lower holder hole, the lower holder hole extending between the first upper surface and the first lower surface and holding the lower conductive resilient member so that the lower conductive resilient member projects from the first lower surface and is accessible through the first upper surface;

a signal conductor having upper and lower ends; and a main housing having a second upper surface and a second lower surface and being formed with a conductor holder, the main housing being mounted on the lower block member with the second lower surface being in contact with the first upper surface, the conductor holder extending between the second upper surface and the second lower surface and holding the signal conductor so that the lower end of the signal conductor is brought into contact with the lower conductive resilient member and that the upper end of the signal conductor is accessible through the second upper surface;

wherein the signal conductor is a high speed signal conductor adapted for high speed signal transmission, the connector further comprising a low speed signal conductor and a pair of ground contacts, the lower conductor being adapted for low speed signal transmission, the low speed signal conductor being held by the main housing, the ground contacts being held by the main housing so that the high speed signal conductor is positioned between the pair of the ground contacts and is positioned away from the low speed signal conductor with one of the pair of the ground contacts left between the low speed signal conductor and the high speed signal conductor.

2. The connector according to claim 1, further comprising a ground plate, wherein the ground plate is electrically connected to the ground contacts, and the ground plate and the pair of the ground contacts are arranged to surround, at least in part, the high speed signal conductor so that the ground plate and the pair of the ground contacts shield the high speed signal conductor.

3. The connector according to claim 1, the connector being fixable on a circuit board which has fit holes, wherein:

the low speed signal conductor has a first fit portion;

the ground contacts have second fit portions, respectively; and the first fit portion and the second fit portions project downwardly from the first lower surface of the lower block member so that, when the connector is fixed on the circuit board, the first fit portion and the second fit portions are press-fit into the fit holes, respectively.

4. The connector according to claim 1, wherein the lower conductive resilient member comprises an elastic block and a conductive film, the elastic block supporting the conductive film so that the conductive film projects from the first lower surface of the lower block member and is brought into contact with the lower end of the signal conductor.

5. The connector according to claim 1, further comprising:

an upper conductive resilient member; and an upper block member having a third upper surface and a third lower surface and being formed with an upper holder hole, the upper block member being mounted on the main housing with the third lower surface being in contact with the second upper surface, the upper holder hole extending between the third upper surface and the third lower surface and holding the upper conductive resilient member so that the upper conductive resilient member projects from the third upper surface and is brought into contact with the upper end of the signal conductor.

6. The connector according to claim 5, wherein the upper conductive resilient member comprises an elastic block and a conductive film, the elastic block supporting the conductive film so that the conductive film projects from the third upper surface of the upper block member and is brought into contact with the upper end of the signal conductor.

7. A mating connector matable with and separatable from the connector as claimed in claim 1, comprising:

a conductive resilient member; and a mating housing being provided with a plate-like portion, the plate-like portion having a first surface and a second surface and being formed with a holder hole, the holder hole extending between the first and the second surfaces, the first surface being in contact with the second upper surface of the main housing in a mating state where the mating connector is mated with the connector, the holder hole holding the conductive resilient member so that the conductive resilient member projects from the second surface of the plate-like portion and, in the mating state, the conductive resilient member is brought into contact with the upper end of the signal contact.

8. A mating connector matable with and separatable from the connector as claimed in claim 1, comprising:

a conductive resilient member;

an additional low speed signal conductor corresponding to the low speed signal conductor;

a pair of additional ground contacts corresponding to the pair of the ground contacts; and a mating housing being provided with a plate-like portion, the plate-like portion having a first surface and a second surface and being formed with a holder hole, the holder hole extending between the first and the second surfaces, the first surface being in contact with the second upper surface of the main housing in a mating state where the mating connector is mated with the connector, the mating housing holding the additional low speed signal conductor and the additional ground contacts so that the additional low speed signal conductor is electrically connected to the low speed signal conductor and that the additional ground contacts are electrically connected to the ground contacts, the holder hole holding the conductive resilient member so that the conductive resilient member projects from the second surface of the plate-like portion and, in the mating state, the conductive resilient member is brought into contact with the upper end of the signal contact.

9. The mating connector according to claim 8, the mating connector being fixable on a mating board which has fit holes, wherein:

the additional low speed signal conductor has a first additional fit portion;

the additional ground contacts have second additional fit portions, respectively; and the first additional fit portion and the second additional fit portions project from the mating housing so that, when the mating connector is fixed on the mating board, the first additional fit portion and the second additional fit portions are press-fit into the fit holes, respectively.

10. A board-to-board connector assembly for use in connecting first and second circuit boards having first and second circuit patterns, respectively, the board-to-board connector assembly comprising a signal conductor, a first conductive resilient member and a second conductive resilient member, the signal conductor having a first end and a second end, the first conductive resilient member being brought into contact with the first end and being adapted to serve as an electrical connection between the first end and the first circuit pattern, the second conductive resilient member being brought into contact with the second end and being adapted to serve as another electrical connection between the second end and the second circuit pattern;

wherein the signal conductor is a high speed signal conductor adapted for high speed signal transmission, the connector further comprising a low speed signal conductor and a pair of ground contacts, the lower conductor being adapted for low speed signal transmission. the low speed signal conductor being held by a main housing, the ground contacts being held by the main housing so that the high speed signal conductor is positioned between the pair of the ground contacts and is positioned away from the low speed signal conductor with one of the pair of the ground contacts left between the low speed signal conductor and the high speed signal conductor.

11. A connector comprising:

a lower conductive resilient member;

a lower block member having a first upper surface and a first lower surface and being formed with a lower holder hole, the lower holder hole extending between the first upper surface and the first lower surface and holding the lower conductive resilient member so that the lower conductive resilient member projects from the first lower surface and is accessible through the first upper surface;

a signal conductor having upper and lower ends;

a main housing having a second upper surface and a second lower surface and being formed with a conductor holder, the main housing being mounted on the lower block member with the second lower surface being in contact with the first upper surface, the conductor holder extending between the second upper surface and the second lower surface and holding the signal conductor so that the lower end of the signal conductor is brought into contact with the lower conductive resilient member and that the upper end of the signal conductor is accessible through the second upper surface;

an upper conductive resilient member; and an upper block member having a third upper surface and a third lower surface and being formed with an upper holder hole, the upper block member being mounted on the main housing with the third lower surface being in contact with the second upper surface, the upper holder hole extending between the third upper surface and the third lower surface and holding the upper conductive resilient member so that the upper conductive resilient member projects from the third upper surface and is brought into contact with the upper end of the signal conductor;

wherein the signal conductor is a high speed signal conductor adapted for high speed signal transmission, the connector further comprising a low speed signal conductor and a pair of ground contacts, the lower conductor being adapted for low speed signal transmission, the low speed signal conductor being held by the main housing, the ground contacts being held by the main housing so that the high speed signal conductor is positioned between the pair of the ground contacts and is positioned away from the low speed signal conductor with one of the pair of the ground contacts left between the low speed signal conductor and the high speed signal conductor.

12. The connector according to claim 11, further comprising a ground plate, wherein the ground plate is electrically connected to the ground contacts, and the ground plate and the pair of the ground contacts are arranged to surround, at least in part, the high speed signal conductor so that the ground plate and the pair of the ground contacts shield the high speed signal conductor.

13. The connector according to claim 11, the connector being fixable on a circuit board which has fit holes, wherein:

the low speed signal conductor has a first fit portion;

the ground contacts have second fit portions, respectively; and the first fit portion and the second fit portions project downwardly from the first lower surface of the lower block member so that, when the connector is fixed on the circuit board, the first fit portion and the second fit portions are press-fit into the fit holes, respectively.

14. A mating connector matable with and separatable from the connector as claimed in claim 11, the mating connector being fixable on a mating board, the mating connector comprising:

an additional low speed signal conductor corresponding to the low speed signal conductor;

a pair of additional ground contacts corresponding to the pair of the ground contacts; and a mating housing receiving the main housing of the connector, the upper conductive resilient member being brought into contact with the mating board when the mating housing receives the main housing so that the mating connector and the connector are put in a mating state, the mating housing holding the additional low speed signal conductor and the additional ground contacts so that, in the mating state, the additional low speed signal conductor is electrically connected to the low speed signal conductor and the additional ground contacts are electrically connected to the ground contacts.

15. The mating connector according to claim 14, further comprising a ground plate, wherein the ground plate is electrically connected to the additional ground contacts, and the ground plate, the pair of the ground contacts and the pair of the additional ground contacts are arranged to surround, at least in part, the high speed signal conductor in the mating state so that the ground plate, the pair of the ground contacts and the pair of the additional ground contacts shield the high speed signal conductor in the mating state.

16. The mating connector according to claim 11, wherein:

the additional low speed signal conductor has a first additional fit portion;

the additional ground contacts have second additional fit portions, respectively; and the first additional fit portion and the second additional fit portions project from the mating housing so that, when the mating connector is fixed on the mating board, the first additional fit portion and the second additional fit portions are press-fit into the fit holes, respectively.

17. A mating connector matable with and separatable from a connector comprising a lower conductive resilient member; a lower block member having a first upper surface and a first lower surface and being formed with a lower holder hole, the lower holder hole extending between the first upper surface and the first lower surface and holding the lower conductive resilient member so that the lower conductive resilient member projects from the first lower surface and is accessible through the first upper surface; a signal conductor having upper and lower ends; a main housing having a second upper surface and a second lower surface and being formed with a conductor holder, the main housing being mounted on the lower block member with the second lower surface being in contact with the first upper surface, the conductor holder extending between the second upper surface and the second lower surface and holding the signal conductor so that the lower end of the signal conductor is brought into contact with the lower conductive resilient member and that the upper end of the signal conductor is accessible through the second upper surface; an upper conductive resilient member; and an upper block member having a third upper surface and a third lower surface and being formed with an upper holder hole, the upper block member being mounted on the main housing with the third lower surface being in contact with the second upper surface, the upper holder hole extending between the third upper surface and the third lower surface and holding the upper conductive resilient member so that the upper conductive resilient member projects from the third upper surface and is brought into contact with the upper end of the signal conductor, said mating connector being fixable on a mating board and comprising a mating housing, the mating housing receiving the main housing of the connector, the upper conductive resilient member being brought into contact with the mating board when the mating housing receives the main housing so that the mating connector is mated with the connector.

18. A board-to-board connector assembly comprising the connector according to claim 5 and the mating connector according to claim 17.

* * * * *

UNITED STATES PATENT AND TRADEMARK OFFICE

CERTIFICATE OF CORRECTION

PATENT NO. : 7,503,773 B2
APPLICATION NO. : 11/600577
DATED : March 17, 2009
INVENTOR(S) : Tokunaga It is certified that error appears in the above-identified patent and that said Letters Patent is hereby corrected as shown below:

In Column 14, line 42, after the word "claim" please change "11" to correctly read: --14--.

Signed and Sealed this

Fifth Day of May, 2009

JOHN DOLL
*Acting Director of the United States Patent and Trademark Office*